US006659012B1

(12) United States Patent
Grassl et al.

(10) Patent No.: US 6,659,012 B1
(45) Date of Patent: Dec. 9, 2003

(54) EJECTION DEVICE FOR EJECTING A PLURALITY OF SUBMUNITIONS AND ASSOCIATED DISCHARGING UNIT

(75) Inventors: Josef Grassl, Schönau (DE); Ralf Heiduczek, Bischofswiesen (DE); Fritz Greindl, Bad Reichenhall (DE); Martin Fegg, Bischofswiesen (DE)

(73) Assignee: Buck Neue Technologien GmbH, Neuenburg (DE)

( * ) Notice: Subject to any disclaimer, the term of this patent is extended or adjusted under 35 U.S.C. 154(b) by 0 days.

(21) Appl. No.: 09/521,414

(22) Filed: Mar. 8, 2000

(30) Foreign Application Priority Data

Mar. 8, 1999 (DE) ..... 199 10 074

(51) Int. Cl.[7] ..... F42B 4/26; F42B 4/06

(52) U.S. Cl. ..... 102/336; 102/342; 102/345; 102/351; 102/357; 102/360

(58) Field of Search ..... 102/336, 338, 102/340, 342, 345, 351, 352, 357, 360

(56) References Cited

U.S. PATENT DOCUMENTS

| | | | | | |
|---|---|---|---|---|---|
| 2,451,981 | A | * | 10/1948 | Schermuly et al. | 102/360 X |
| 3,013,493 | A | * | 12/1961 | Fletcher | 102/340 |
| 3,142,959 | A | * | 8/1964 | Klein | 102/352 X |
| 3,199,406 | A | * | 8/1965 | Gould | 102/352 X |
| 4,222,306 | A | * | 9/1980 | Maury | 102/342 X |
| 4,325,304 | A | * | 4/1982 | Ormiston | 102/360 X |
| 4,621,579 | A | * | 11/1986 | Badura et al. | 102/340 X |
| 4,791,870 | A | * | 12/1988 | Simpson | 102/357 X |
| 4,869,174 | A | * | 9/1989 | Hanser et al. | 102/340 X |
| 5,157,222 | A | * | 10/1992 | La Mura et al. | 102/360 X |
| 5,317,975 | A | * | 6/1994 | Sauvestre et al. | 102/357 X |
| 5,429,052 | A | | 7/1995 | Bross et al. | 102/217 |
| 5,454,324 | A | * | 10/1995 | Larmignat et al. | 102/342 X |
| 5,551,345 | A | * | 9/1996 | Wardecki et al. | 102/360 X |
| 5,623,113 | A | * | 4/1997 | Valembois | 102/360 X |
| 6,279,482 | B1 | * | 8/2001 | Smith et al. | 102/357 X |

FOREIGN PATENT DOCUMENTS

| | | |
|---|---|---|
| AT | Nr. 330 030 | 6/1976 |
| DE | 25 52 052 | 5/1976 |
| DE | 3516793 | 11/1985 |
| EP | 0 124 183 A2 | 11/1984 |
| EP | 0588 015 | 3/1994 |
| FR | 2 294 420 | 7/1976 |
| GB | 2 188 920 A | 10/1987 |

* cited by examiner

*Primary Examiner*—Peter A. Nelson
(74) *Attorney, Agent, or Firm*—Sughrue Mion, PLLC

(57) ABSTRACT

An ejection device for ejecting a plurality of submunitions (24*a–d*) having an adapter (10) including a control unit (12, 13, 14*a–c*, 15*a–b*, 16) and adapted for releasable fastening in an ejection barrel (2) of a discharger (1), and a submunitions cluster (20) including the submunitions and adapted for releasable connection, both mechanical and electrical, with the adapter. In the assembled condition of the device, the submunitions cluster is connected with the adapter, permitting submunitions to be ejected from the submunitions cluster. The control unit of the adapter controls the device to eject submunitions in one or more of a variety of ejection modes, such as sequentially one by one or at least in part simultaneously. The period between ejection of two consecutive submunitions may be adjustable. The ejection device may be integrated into a discharging unit including at least one discharger (1), such as a conventional discharging unit.

33 Claims, 4 Drawing Sheets

EJECTION DEVICE FOR EJECTING A PLURALITY OF SUBMUNITIONS AND ASSOCIATED DISCHARGING UNIT

The following disclosure is based on German Application No. 19910074.8, filed on Mar. 8, 1999, the disclosure of which is incorporated into this application by reference.

FIELD OF THE INVENTION

The present invention relates to a device for ejecting a plurality of submunitions, and to a discharging unit employing such a device.

BACKGROUND OF THE INVENTION

The implementation of protection measures frequently makes it necessary to eject a multiplicity of submunitions. In general, such submunitions serve for purposely generating an artificial fog over a particular period of time as an important measure to camouflage military targets or deceive objects attacking these targets. For example, EP 0 588 015 A1 teaches a masking method for protecting a tank equipped with a heat imaging apparatus against an enemy tank equally equipped with a heat imaging apparatus. According to the method, a unilaterally transparent, infrared fog is generated, so that the tank to be protected is separated from the attacking tank by a masking wall, which is transparent only from the side of the tank to be protected.

Also well-known are circuit arrangements for ejecting decoy sub-members in a freely selectable time sequence from a cartridge barrel by triggering ejection charges each connected to electrical ignition circuits by means of an electrical igniter and each connected to a sub-munition. Thus, e.g., U.S. Pat. No. 5,429,052, the disclosure of which is incorporated herein by reference, discloses such a circuit arrangement with automatic, successive relaying of ignition pulses.

SUMMARY OF THE INVENTION

It is an object of the present invention to provide an ejection device and associated discharge unit capable of ejecting a multiplicity of submunitions independently of caliber. It is a further object of the invention to provide such a device and unit which have a simplified electrical contact design and which can be manufactured at reduced expense in terms of installation work.

These and other objects are achieved in accordance with the invention by a device for ejecting a multiplicity of submunitions which comprises an adapter including a control unit and adapted for releasable fastening in an ejection barrel of a discharger, and a submunitions cluster including the submunitions and adapted for releasable connection, both mechanical and electrical, with the adapter. Advantageously, in the assembled condition, in which the submunitions cluster is connected to the adapter, submunitions may be ejected from the submunitions cluster by way of the control unit of the adapter in one or more of a variety of ejection modes. Preferably, such modes include ejection sequentially one by one, where the period between ejection of two consecutive -submunitions is preferably adjustable, or simultaneous ejection, at least of a portion of said submunitions.

DETAILED DESCRIPTION OF THE PREFERRED EMBODIMENTS

Figure 1:
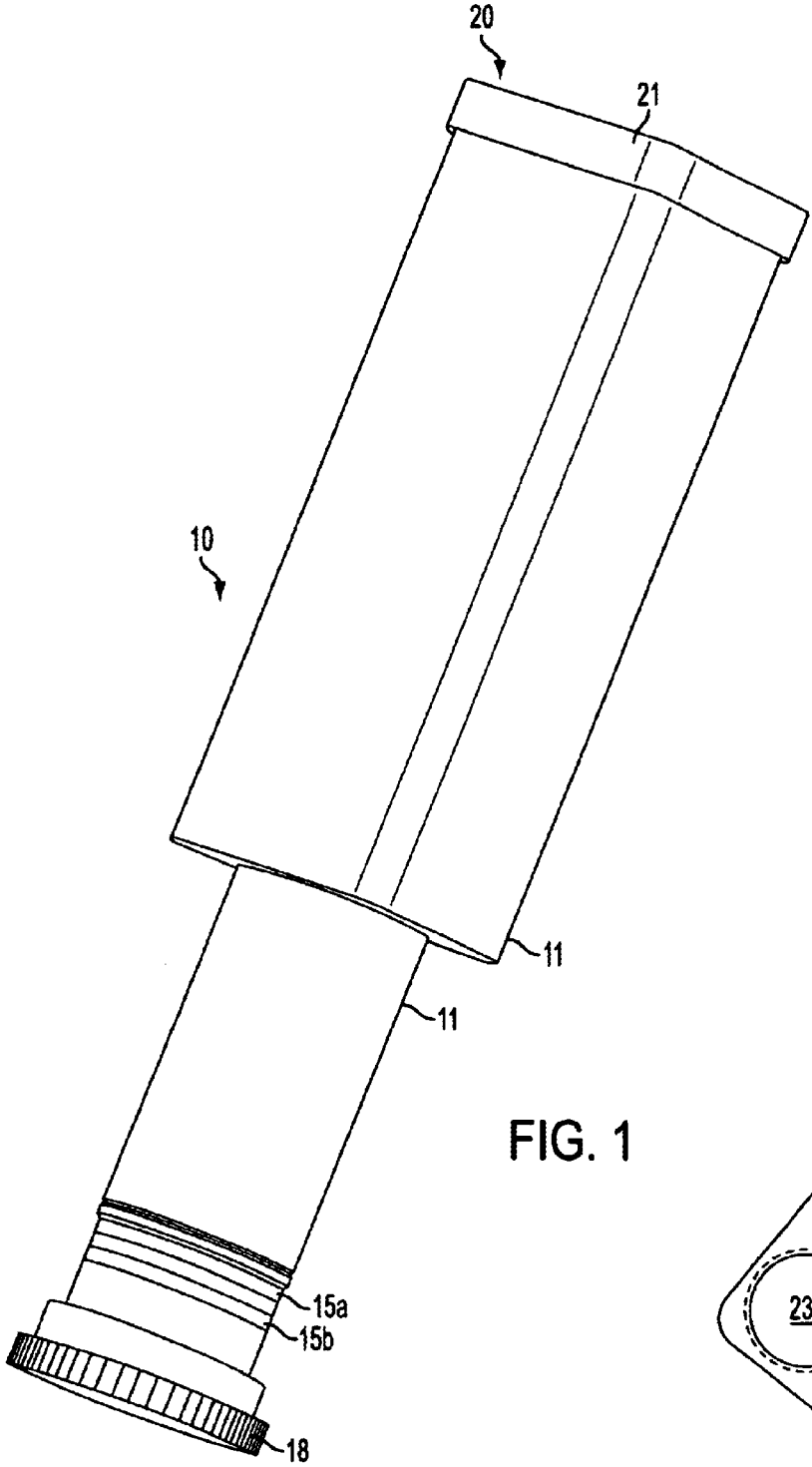
FIG. 1 is a perspective view of a device according to the invention including an adapter and a submunitions cluster placed thereon.

As described above, the objects of the present invention are achieved by a device for ejecting a multiplicity of submunitions. This device includes an adapter having a control unit and is configured to releasably fasten in an ejection barrel of a discharger, and a submunitions cluster configured to hold the submunitions. The submunitions cluster, in turn, is configured to releasably connect, both mechanically and electrically, with the adapter. In the assembled condition in which the submunitions cluster is connected to the adapter, submunitions can be ejected from the submunitions cluster under control of the control unit of the adapter preferably sequentially one by one and/or at least in part simultaneously. The period between ejection of two consecutive submunitions is preferably adjustable.

The control unit preferably includes a battery, contact rings, at least one circuit board for electronic circuitry and contact pins, which are preferably resilient. The control unit, further, is preferably configured to be inserted in an adapter housing in a tightly sealing manner and to releasably fasten thereto.

Moreover, in accordance with a refinement of the invention, the submunitions cluster mechanically connects with the adapter by means of a clamping connection, snap connection or the like. An electrical circuit between the submunitions cluster and the adapter closes automatically as soon as the submunitions cluster and the adapter are mechanically connected.

Preferably, the submunitions cluster is connected electrically with the adapter by contacting the contact pins of the control unit of the adapter with complementary contact locations of the submunitions cluster. The contact locations are electrically connected with at least one means for expelling submunitions from the submunitions cluster.

The ejection device in accordance with the invention preferably has a submunitions cluster including at least one ejection barrel. In each ejection barrel, two or more submunitions are serially arranged in the expelling direction, four submunitions per ejection barrel being preferred.

The invention furthermore proposes that one propellant charge including igniting means such as a primer or the like is associated with each submunition. Each propellant charge is preferably connected with the control unit of the adapter in the assembled condition of the submunitions cluster and the adapter.

The propellant charges for the submunitions of each ejection barrel are preferably arranged outside their respective ejection barrels. The means for igniting the propellant charges also are arranged outside their respective ejection barrels.

According to a further aspect of the invention, the propellant charges together with the igniting means for the submunitions of each ejection barrel of the submunitions cluster are arranged in common propellant charge rails associated respectively with each of the ejection barrels. The igniting means is preferably placed in electrical contact with the control unit of the adapter via the propellant charge rail. Preferably, the electrical contact includes an intermediary arrangement of at least one circuit board establishing an electronic circuit with the contact locations.

Herein it is preferred that the propellant charge rail assigned to an ejection barrel of the submunitions cluster extend externally of and in parallel with the longitudinal center axis of that ejection barrel and be releasably connected with that ejection barrel. Preferably, propellant charge gases enter into the ejection barrel of the submunitions cluster via lateral bores in the ejection barrel for ejecting associated ones of the submunitions.

In accordance with the invention, each lateral bore in the ejection barrel of the submunitions cluster preferably communicates with a gas compartment underneath a submunition located inside that ejection barrel.

It is moreover preferred that a sensor is arranged in each ejection barrel of the submunitions cluster, preferably in the proximity of the one submunition to be ejected last from this ejection barrel. The sensor is electrically connected with the control unit of the adapter.

The invention furthermore proposes that two or more ejection barrels are arranged in parallel with each other in a submunitions cluster. The ejection barrels are mutually connected by way of a common electrical connection panel. This connection is preferably the above-mentioned at least one circuit board establishing the electrical circuit with the contact locations.

A particular embodiment of the invention is characterized in having four ejection barrels per submunitions cluster, with preferably two ejection barrels each being arranged in laterally aligned arrangement.

Preferably, the ejection device is configured to eject the submunitions barrel by barrel.

The invention is also directed to a discharging unit including at least one discharger, which is characterized by an ejection device in accordance with the invention, as described above.

The submunitions are preferably arranged outside of the ejection barrel of the discharger when the adapter is fastened in the discharger and the submunitions cluster is fastened to the adapter.

The adapter of the discharging unit is preferably configured to be clamped in the ejection barrel of the discharger, such as by means of a threaded connection. This allows the adapter to be removed from the ejection barrel of the discharger, which may be desired for performing maintenance or if the discharger is needed for ejecting conventional ammunition.

A part of the invention as a whole thus includes the surprising insight that, by intermediate arrangement of an adapter between a discharger and a submunitions cluster, a number of considerable advantages can be achieved. First, the volume, i.e. capacity, available for submunitions to be ejected can be increased considerably. Second, it becomes possible to overcome dependency on a specific caliber of submunition. Third, the contact head within the discharger unit is shielded from external sources of dirt, grime and other contamination. Fourth, the wiring of the device can be simplified and the device can be made easier to service and handle. This altogether results in considerable cost savings. In particular, the present invention makes it possible to do away with the conventionally tolerated need for using different dischargers for ejection of particular numbers and/or a particular types of submunitions. Further cost savings are achieved through an associated reduction in maintenance requirements and costs. Moreover, the range of application of a discharging unit in accordance with the invention is expanded owing to its modular structure, which is particularly advantageous in tactical and strategic respects.

Further features and advantages of the invention will become evident from the following description giving a detailed explanation of preferred embodiments of the invention, with reference to schematic drawings.

As can be seen from FIG. 1, one representative, preferred embodiment of the device in accordance with the invention includes an adapter 10 and a submunitions cluster 20 which are constructed to releasably connect to each other, both electrically and mechanically.

Figure 3:
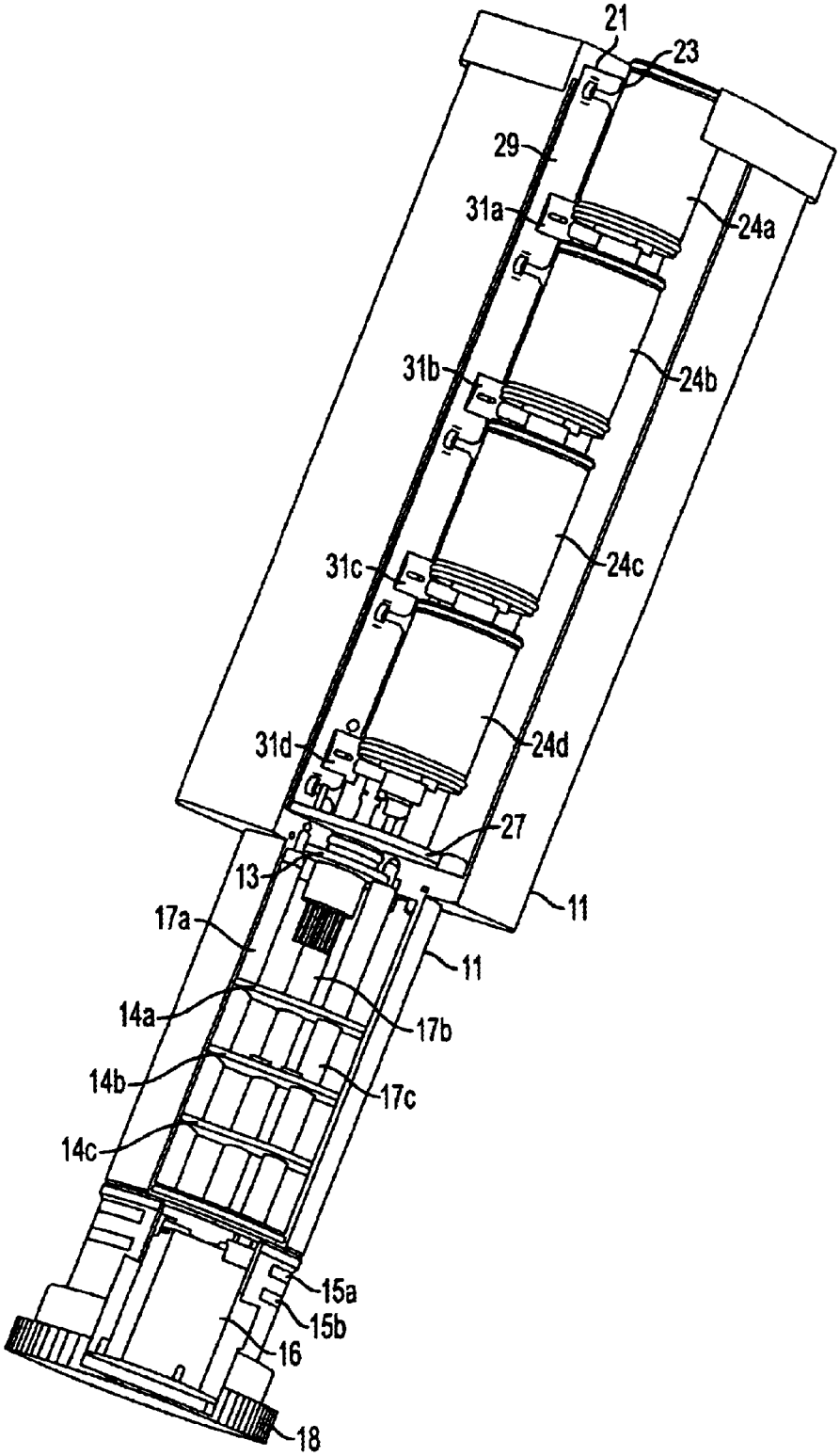
FIG. 3 is a partially sectional view of FIG. 1.
Figure 4:
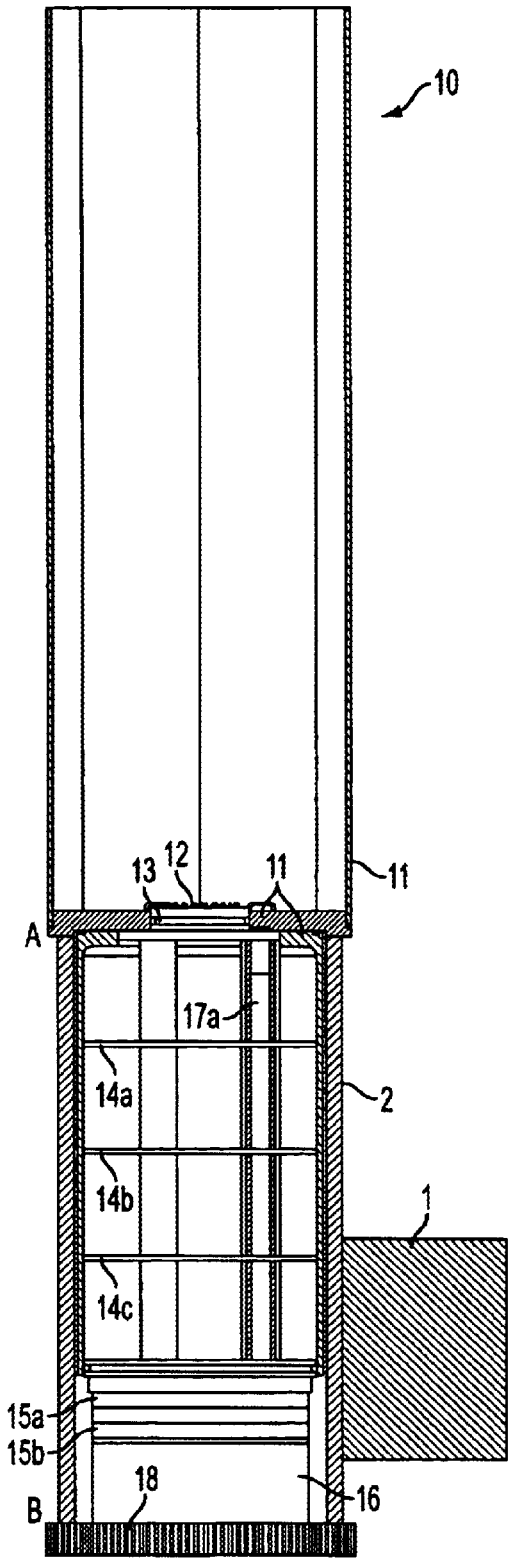
FIG. 4 is a partially sectional view of the adapter of FIG. 1.

The adapter 10, shown more specifically in FIG. 4, has the following construction:

A control unit is fastened inside an adapter housing 11 by means of fastening screws 17*a*, 17*b*, 17*c*, as is also indicated in FIG. 3. The control unit, in turn, includes resilient contact pins 12 located on a contact pin carrier 13 contacted to an electronic control on circuit boards 14*a*, 14*b*, 14*c* which, in turn, are electrically connected with a battery 16.

The control unit is moreover adapted to be externally controlled by way of its contact rings 15*a*, 15*b* via a discharger 1. To this end, the adapter 10 is preferably inserted into the ejection barrel 2 of the discharger 1 from below in such a way that the control unit, with the exception of the contact pins 12 on the contact pin carrier 13, is positioned inside the ejection barrel 2 of the discharger 1, i.e., in the region between points A and B of FIG. 4. The adapter 10 clamps or otherwise fastens in the ejection barrel of the discharger 1, for instance, by means of an adapter screw 18.

The submunitions cluster 20 in accordance with the invention is preferably constructed as follows, with reference in particular to FIG. 5:

A submunitions cluster housing 21 presents a fastening groove 22 for mechanical connection to the adapter housing 11, with the assembled condition of adapter 10 and submunitions cluster 20 being represented in FIGS. 1 and 3.

Figure 2:
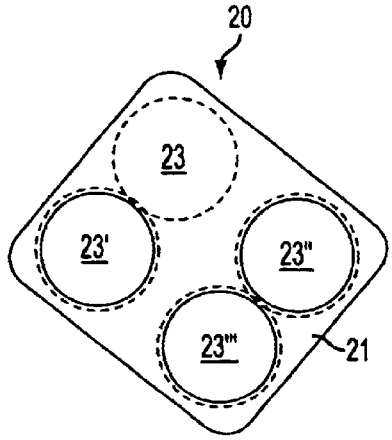
FIG. 2 is a top view of the submunitions cluster of FIG. 1 when viewed from the end facing away from the adapter.
Figure 5:
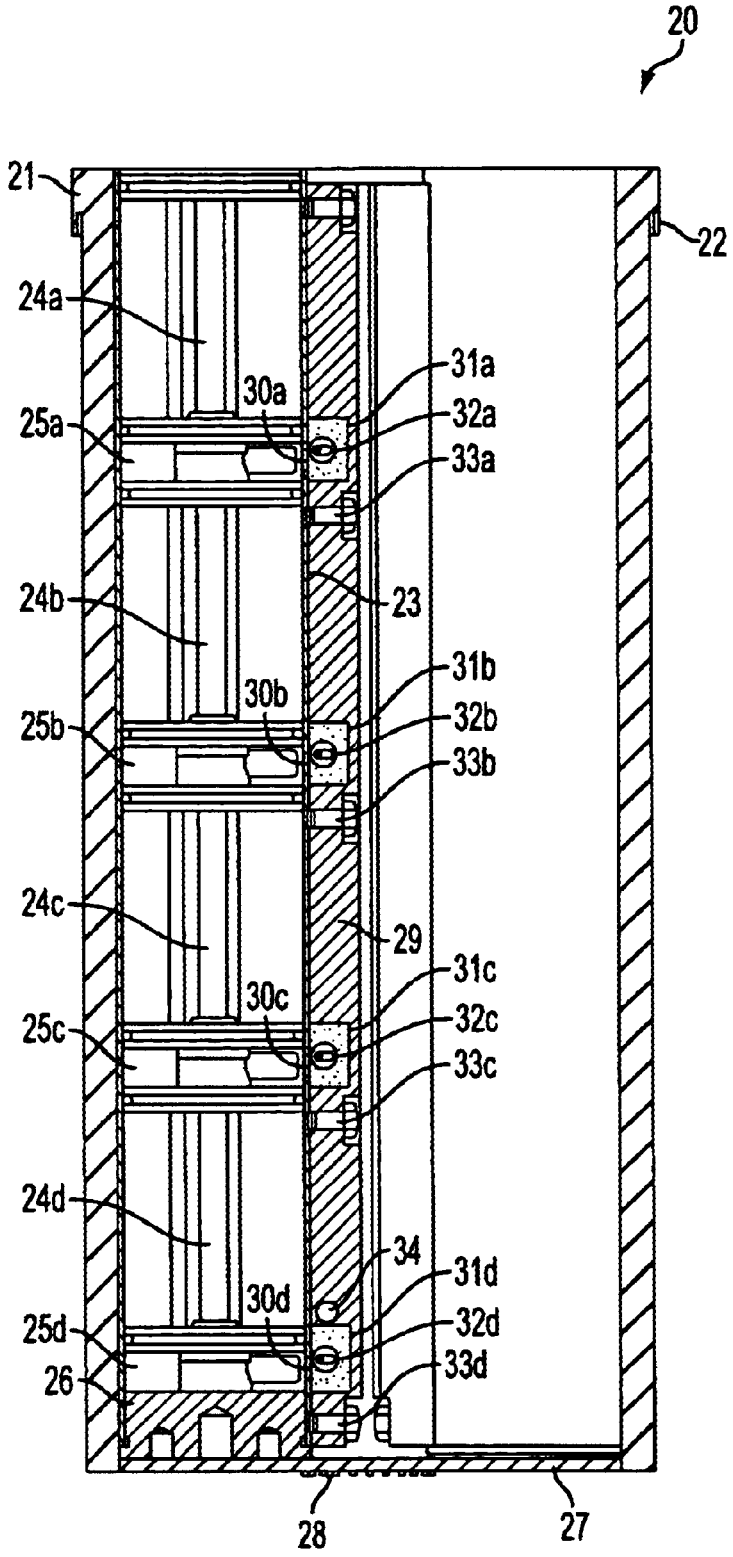
FIG. 5 is a partially sectional view of the submunitions cluster of FIG. 1.

Inside the submunition housing 21, four ejection barrels 23, 23', 23", 23'" are arranged in two rows in parallel with each other, see FIG. 2, only one of which is visible in section in FIG. 5.

Inside each ejection barrel 23, four submunitions 24*a*, 24*b*, 24*c*, 24*d*, each having a respective gas compartment 25*a*, 25*b*, 25*c*, 25*d* arranged underneath are serially inserted in the direction of ejection. Underneath the lowermost gas compartment 25*d*, the ejection barrel 23 is closed by a bottom lid 26. The bottom lid 26 is connected to a circuit board 27 having an electrical circuit and contact locations 28 that electrically contact with the contact pins 12 on the contact pin carrier 13 of the adapter 10 mounted thereon.

Each ejection barrel 23 comprises lateral bores 30*a*, 30*b*, 30*c*, 30*d*in the vicinity of the gas compartments 25*a*, 25*b*, 25*c*, 25*d* to provide a connection with a propellant charge rail 29. The propellant charge rail 29 for each ejection barrel 23 extends in parallel with the ejection barrel 23 and connects to the ejection barrel 23 via respective threaded bolts 33*a*, 33*b*, 33*c*, 33*d*. One propellant charge 31*a*, 31*b*, 31*c*, 31*d*, together with primer 32*a*, 32*b*, 32*c*, 32*d* for each submunition 24*a*, 24*b*, 24*c*, 24*d* in the ejection barrel 23, is arranged in the propellant charge rail 29. The primers 32*a*, 32*b*, 32*c*, 32*d*, in turn, are electrically connected with the control unit located inside the adapter 10 by way of the circuit board 27 and the contact locations 28 of the submunitions cluster 20 in the assembled condition of adapter 10 and submunitions cluster 20, as is indicated in FIG. 3.

The submunitions cluster 20 finally moreover includes a temperature sensor 34 in the vicinity of the one submunition 24*d* to be ejected last from the ejection barrel 23. This temperature sensor 34 is also electrically connected with the control unit in the adapter 10 by way of the circuit board 27 and specifically with the contact locations 28 when the submunitions cluster 20 is fitted to the adapter 10 in the manner shown in FIG. 3.

A discharger in accordance with the invention including the above described device is, for example, preferably constructed as follows for ejecting a multiplicity of submunitions:

The control unit 12, 13, 14*a*, 14*b*, 14*c*, 15*a*, 15*b*, 16 is introduced, from below in the representations of FIGS. 3 and 4, into the adapter housing 11 and is immobilised there by means of the three fastening screws 17*a*, 17*b*, 17*c*. Sealing inside the adapter housing 10 against environmental influences is ensured by O-rings not shown here. The adapter housing 11 is inserted into the ejection barrel 2 of the discharger 1, and the positional arrangement of the adapter 10 is immobilised inside the discharger 1 by tightening the adapter screw 18. The adapter 10 thus mounted need be removed from the discharger 1 only for regular maintenance purposes or if conventional ammunition is to be discharged from the discharger.

The four ejection barrels 23, 23', 23", 23'" with their respective propellant charge rails 29 mounted thereon and submunitions 24*a*, 24*b*, 24*c*, 24*d* loaded therein are inserted into the submunitions cluster housing 21. Herein the four ejection barrels 23, 23', 23", 23'" are connected with each other by means of the bottom lid 26 of the submunitions cluster 20 which supports the circuit board 27.

The submunitions cluster 20 is fitted on the adapter 10 located inside the discharger 1 from above in the representation of FIGS. 1 and 3, whereby the clamping groove 22 provides for a firm mechanical connection and the contact locations 28 of the submunitions cluster 20 enter into contact with the contact pins 12 of the adapter 10. The arrangement of the contacts 12, 28 in relation to the clamping groove 22 is designed to prevent erroneous contacting.

As a result of the larger space for the submunitions 24*a*, 24*b*, 24*c*, 24*d* due to the intermediate arrangement of the adapter 10, it becomes possible to selectively discharge a total of sixteen submunitions 24*a*, 24*b*, 24*c*, 24*d* from four ejection barrels 23, 23', 23", 23'" by means of a single discharger 1. This is highly effective, e.g., in building up a desired screening wall at a selected distance over a selected period.

If it is, for example, intended, in a first step, to eject only submunitions 24*a*, 24*b*, 24*c*, 24*d* of ejection barrel 23, a corresponding signal is supplied to the contact rings 15*a*, 15*b*of the adapter 10 and transmitted to the corresponding primers 32*a*, 32*b*, 32*c*, 32*d* via the electronic control of the adapter and the circuit board 27 of the submunitions cluster 20. By triggering a primer, for example primer 32*a*, the corresponding propellant charge 31*a* is ignited, so that propellant charge gas enters into the associated gas compartment 25*a* by way of the corresponding bore 30*a*. This, in turn, leads pressure to build up until the submunition 24*a* located above this gas compartment 25*a* in the discharging direction is finally ejected from the ejection barrel 23. This analogously applies to ejection of the three remaining submunitions 24*b*, 24*c*, 24*d*. The charge condition of the ejection barrel 23 may be examined during ejection by means of the temperature sensor 34.

It is, of course, also possible to control the four ejection barrels 23, 23', 23", 23'" consecutively with a specific delay, in groups, or simultaneously, in order to eject their respective submunitions 24*a*, 24*b*, 24*c*, 24*d*. This provides the highly advantageous option of building up a smoke screen required for masking or protection within a period as brief as only a few seconds. The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed:

1. A device for ejecting a multiplicity of submunitions, comprising:

an adapter including a control unit and adapted to releasably fasten in an ejection barrel of a discharger, said releasably fastened adapter being positionally separate and functionally distinct from the discharger, and a submunitions cluster including said submunitions and adapted to connect, both mechanically and electrically, to said adapter.

2. The device according to claim 1, wherein, in an assembled condition in which said submunitions cluster is connected with said adapter, said adapter and said submunitions cluster are configured to eject said submunitions, in response to control signals from said control unit, selectively in accordance with one of a plurality of ejection modes.

3. The device according to claim 2, wherein the ejection modes include at least one of:

(a) ejecting a plurality of said submunitions from said submunitions cluster sequentially one by one, and (b) ejecting a plurality of said submunitions from said submunitions cluster simultaneously.

4. The device according to claim 2, wherein a period between ejection of two consecutive submunitions is adjustable in response to the control signals from said control unit in accordance with at least one of the plurality of ejection modes.

5. The device according to claim 1, wherein:

said adapter further comprises an adapter housing;

said control unit comprises at least one battery, a plurality of contact rings, at least one circuit board of electronic circuitry, and contact pins; and said control unit is adapted to insert into said adapter housing and releasably fasten to said adapter housing.

6. The device according to claim 5, wherein said contact pins are resilient.

7. The device according to claim 1, wherein:

said submunitions cluster is mechanically connected with said adapter by means of at least one of a clamp connection and a snap connection; and an electrical circuit between said submunitions cluster and said adapter is arranged to close automatically when said submunitions cluster is mechanically connected with said adapter.

8. The device according to claim 5, wherein:

said submunitions cluster comprises at least one means for ejecting said submunitions;

said submunitions cluster further comprises complementary contact locations that are arranged to electrically connect with said adapter by contacting said contact pins; and said contact locations are electrically connected with said at least one means for ejecting said submunitions.

9. The device according to claim 1, wherein:

said submunitions cluster comprises at least one ejection barrel;

each said ejection barrel is configured to hold at least two submunitions serially in an ejection direction.

10. The device according to claim 9, wherein:

each said ejection barrel is configured to hold four submunitions.

11. The device according to claim 9, wherein:

said submunitions cluster comprises one propellant charge including an igniter associated with each said submunition; and each said propellant charge is connected with said control unit of said adapter in the assembled condition in which said submunitions cluster is connected with said adapter.

12. The device according to claim 11, wherein said igniter comprises a primer.

13. The device according to claim 11, wherein:

said submunitions cluster comprises a plurality of ejection barrels for holding said submunitions;

each said ejection barrel is configured to hold at least two submunitions serially in an ejection direction;

said propellant charges for said submunitions of each said ejection barrel are arranged outside each said ejection barrel, respectively; and said igniters are arranged outside each said ejection barrel, respectively.

14. The device according to claim 13, wherein:

said submunitions cluster further comprises a plurality of propellant charge rails each associated respectively with one of said ejection barrels;

said propellant charges with said igniters are respectively arranged in said propellant charge rails; and an electrical contact is provided between each said igniter and said control unit via said respective propellant charge rails.

15. The device according to claim 14, wherein:

said submunitions cluster further comprises contact locations arranged to electrically connect with said adapter;

said electrical contact of said respective igniters with said control unit of said adapter includes at least one circuit board intermediate between said igniters and said contact locations.

16. The device according to claim 14, wherein:

each said propellant charge rail extends externally of an associated one of said ejection barrels and extends in parallel with a longitudinal center axis of said associated ejection barrel;

each said propellant charge rail is configured to releasably connect with said associated ejection barrel; and each said ejection barrel comprises lateral bores configured to pass propellant charge gases into said ejection barrel when said submunitions are being ejected.

17. The device according to claim 16, wherein:

each said lateral bore of each said ejection barrel communicates with a respective gas compartment provided underneath a respective one of said submunitions located inside said ejection barrel.

18. The device according to claim 9, wherein said ejection barrel of said submunitions cluster comprises a sensor electrically connected with said control unit of said adapter.

19. The device according to claim 18, wherein said sensor is arranged most proximate to one of said submunitions disposed to be ejected last from said ejection barrel.

20. The device according to claim 1, wherein:

said submunitions cluster comprises at least two ejection barrels arranged in parallel with each other; and said ejection barrels are mutually connected by a common panel having an electrical interconnection of said ejection barrels.

21. The device according to claim 20, wherein:

said control unit comprises at least one circuit board of electronic circuitry as said common panel having the electrical interconnection;

said submunitions cluster comprises complimentary contact locations arranged to electrically connect with said adapter; and said circuit board is electrically connected with said contact locations.

22. The device according to claim 20, wherein said submunitions cluster comprises four ejection barrels arranged in parallel with each other.

23. The device according to claim 22, wherein each of said four ejection barrels is laterally aligned with at least one other of said ejection barrels.

24. A device according to claim 20, wherein said adapter and said submunitions cluster are configured to eject, in response to the control signals from said control unit, all of said submunitions disposed in a first of said ejection barrels before ejecting said submunitions disposed in a second of said ejection barrels.

25. A discharging unit comprising:

at least one discharger comprising an ejection barrel;

an adapter including a control unit and adapted to releasably fasten in said ejection barrel of said discharger, said releasably fastened adapter being positionally separate and functionally distinct from said discharger; and a submunitions cluster including submunitions and adapted to connect, both mechanically and electrically, to said adapter.

26. The discharging unit according to claim 25, wherein, in an assembled condition in which said adapter is fastened in said ejection barrel and said submunitions cluster is connected with said adapter, said adapter and said submunitions cluster are configured to eject said submunitions, in response to control signals from said control unit, selectively in accordance with one of a plurality of ejection modes.

27. The discharging unit according to claim 25, wherein said submunitions are arranged outside of said ejection barrel of said discharger in the assembled condition in which said adapter is fastened in said ejection barrel and said submunitions cluster is connected with said adapter.

28. The discharging unit according to claim 25, wherein said adapter comprises a threaded connection for releasably fastening said adapter to said ejection barrel of said discharger, which is configured to eject conventional ammunition other than said submunitions.

29. The device according to claim 1, wherein:

said adapter further comprises an adapter housing; and said control unit comprises a plurality of contact rings and at least one circuit board of electronic circuitry.

30. The device according to claim 1, wherein the connection of the submunitions cluster to the adapter is configured as a releasable connection.

31. The device according to claim 25, wherein the connection of the submunitions cluster to the adapter is configured as a releasable connection.

32. A device for ejecting a multiplicity of submunitions, comprising:

an adapter including a control unit and adapted to fasten in an ejection barrel of a discharger, and a submunitions cluster including said submunitions and adapted to connect, both mechanically and electrically, to said adapter;

wherein:

said submunitions cluster comprises at least one propellant charge including an igniter associated with each said submunition;

each said propellant charge is connected with said control unit of said adapter when said submunitions cluster is connected with said adapter;

said submunitions cluster comprises a plurality of ejection barrels for holding said submunitions;

each said ejection barrel is configured to hold at least two submunitions serially in an ejection direction;

said propellant charges for said submunitions of each said ejection barrel are arranged outside each said ejection barrel, respectively;

said igniters are arranged outside each said ejection barrel, respectively;

said submunitions cluster further comprises a plurality of propellant charge rails each associated respectively with one of said ejection barrels; and an electrical contact is provided between each said igniter and said control unit via said respective propellant charge rails.

33. The device according to claim 32, wherein the connection of the submunitions cluster to the adapter is configured as a releasable connection.

* * * * *